US005326576A

United States Patent [19]

Zuege

[11] Patent Number: 5,326,576

[45] Date of Patent: Jul. 5, 1994

[54] CONTAINER APPARATUS

[75] Inventor: John C. Zuege, Fowler, Ind.

[73] Assignee: A B Specialty Packaging, Inc., Hialeah, Fla.

[21] Appl. No.: 871,236

[22] Filed: Apr. 20, 1992

[51] Int. Cl.[5] ..... A23L 1/18; B65D 81/34

[52] U.S. Cl. ..... 426/107; 383/95; 383/120; 426/111; 426/113

[58] Field of Search ..... 426/107, 111, 113, 234; 219/10.55 E; 383/95, 120

[56] References Cited

U.S. PATENT DOCUMENTS

| | | | |
|---|---|---|---|
| 3,835,280 | 9/1974 | Gades | 219/10.55 E |
| 3,973,045 | 8/1976 | Brandberg | 426/110 |
| 4,219,573 | 8/1980 | Borek | 426/107 |
| 4,283,427 | 8/1981 | Winters | 426/107 |
| 4,450,180 | 5/1984 | Watkins | 426/107 |
| 4,553,010 | 11/1985 | Bohrer | 219/10.55 E |
| 4,691,374 | 9/1987 | Watkins et al. | 383/120 X |
| 4,735,513 | 4/1988 | Watkins | 383/116 |
| 4,904,488 | 2/1990 | LaBaw et al. | 426/107 |

*Primary Examiner*—Leo B. Tentoni
*Attorney, Agent, or Firm*—Dick and Harris

[57] ABSTRACT

A container apparatus for use in filling, storing, shipping and cooking various types of food wherein the container apparatus facilitates and maintains the positioning of the food in a substantially restricted predetermined location within the apparatus. The container apparatus includes a bag having a front and back panel, a first and second gusseted side panel and an interior region. Bag panel attachment elements are positioned between a portion of the back panel means and an adjacent portion of the gusseted side panels preliminarily to filling, so as to maintain the back flaps of the gusseted side panels against the back panel during such filling, as well as during storing, shipping and cooking of the food. The bag panel attachment elements further serve to operably segregate and maintain the food in a predetermined portion of the interior region so that the food does not inadvertently migrate between the gussets and the back panel during filling.

12 Claims, 2 Drawing Sheets

CONTAINER APPARATUS

BACKGROUND OF THE INVENTION

The present invention relates in general to containers used for filling, storing, shipping and cooking food, such as popcorn, in an oven, such as a microwave oven. More particularly, the invention relates to a container apparatus wherein the apparatus facilitates and maintains the positioning of the food during filling, storing, shipping and cooking in a substantially restricted predetermined location within the interior region of the container apparatus. The apparatus accordingly maximizes exposure of the food to a heat enhancement device during the actual cooking process, to, in turn, enhance cooking uniformity and quality of the cooked food.

Containers for cooking food in an oven, whether it be of the conventional type or a microwave oven, have been known in the art for many years. Indeed, many of such containers have incorporated gusseted side panels and utilization of heat enhancement devices operably attached, or exposed to, one of the panels of the container itself. Furthermore, some of such prior art, have disclosed a defined interior region for acceptance of the food to be cooked during and after filling, as well as during the storing, shipping and cooking of the food. Examples of the prior art include: Brandberg, U.S. Pat. No. 3,973,045; Bohrer, U.S. Pat. No. 4,553,010; Winters, U.S. Pat. No. 4,283,427; Borek, U.S. Pat. No. 4,219,573; Gades, U.S. Pat. No. 3,835,280; and Watkins, U.S. Pat. No. 4,735,513. In addition, other prior art, such as Watkins, U.S. Pat. No. 4,450,180, disclose that narrow and enlarged tube sections can be defined by the gussets to enhance the cooking of popcorn.

Although the prior art does disclose containers having a defined interior region positioned between the gussets and one of the front or back panels of the bag itself, few, if any of such prior art containers teach altering the interior region to maximize direct exposure of the food to the heat enhancer. Furthermore, few, if any of such prior art discloses an interior region which is configured to substantially preclude the inadvertent migration of food between the back side of the gussets and the panel adjacent to that back side, preliminarily to filling, so as to maintain substantially all of the food to be cooked directly proximate to the heat enhancement device during cooking, to, in turn, facilitate uniform and complete cooking of the food.

It is thus an object of the present invention to provide a container apparatus which utilizes bag panel attachment means for attaching a portion of the gusseted side panels and the front or back panel not positioned adjacent the heat enhancer during the cooking of the food, so as to maintain the food to be cooked adjacent the front or back panel which is adjacent the heat enhancer—so as to provide uniform and complete cooking of the food.

It is also an object of the present invention to provide a container apparatus wherein the bag panel attachment means on the front or back panel are attached to corresponding portions of the gusseted side panels prior to filling the bag with food and accordingly, prior to sealing the top ends of the bag.

It is still further an object of the present invention to provide a container apparatus which precludes the inadvertent migration of the food as it is being filled within the bag means, between the gusseted side panels and the front or back panel which is operably attached to the gusseted side panel by the bag panel attachment means.

It is yet another object of the present invention to provide a container apparatus which can be used in association with an integrally attached heat enhancer or a separate heat enhancer contained in a portion of the oven.

These and other objects of the present invention will become apparent in light of the present specification, claims and drawings.

SUMMARY OF THE INVENTION

The present invention comprises a container apparatus for use in filling, storing, shipping and cooking various types of food, such as popcorn, in which the container apparatus facilitates and maintains the positioning and cooking of the food in a substantially restricted predetermined location within the cooking apparatus to, in turn, maximize exposure of said food, during cooking, to a heat enhancer positioned within an oven, such as a microwave oven, or positioned within the container apparatus itself—towards improving and enhancing the cooking of the food therewithin.

The apparatus comprises bag means having front and back panels having first and second sides which respectively converge at first and second opposite sides of the bag means. The bag means also include first gusseted side panel means at the first side of the bag means for operably connecting the first side of each of the front and back panel means, and second gusseted side panel means at the second side of the bag means for operably connecting the second side of each of the front and back panel means.

Each of the first and second gusseted side panel means are operably positioned adjacent to each of the front and back panel means, respectively, so as to be opposite in position to each other.

The front and back panel means and the first and second gusseted side panel means each have an exterior surface, an interior surface collectively defining an interior cooking region, a top end and a bottom end, wherein the bottom ends are operably configured to form a substantially sealed bottom region. The first and second gusseted side panel means each include a first flap having a first side edge operably attached to the first and second sides of the front panel means, respectively, and a second side edge operably positioned opposite to the first side edge of the first flap, and extending inwardly toward the interior region of the bag means. In addition, the first and second gusseted side panel means also include a second flap having a first side edge operably attached to the first and second side of the back panel means, respectively, and a second side edge operably positioned opposite to the first side edge of the second flap, and extending inwardly toward the interior region of the bag means. Each of the second side edges of the first and second flaps are attached to each other respectively, so as to form inwardly extending gussets.

Heat enhancement means are operably positioned proximate to the front panel means of the bag means for intensifying or concentrating heat, to enhance the cooking of the food. Bag panel attachment means are operably positioned between the second flaps of the first and second gusseted side panel means and the back panel means, preliminarily to filling the bag with the food. The bag panel attachment means serve to maintain the respective second flaps substantially juxtaposed against the back panel means during the filling, storing and shipping of the bag means and during at least a portion of the cooking of the food within the bag means. The bag panel attachment means operably segregate and maintain the food in the interior region during filling, storing and shipping of the apparatus for maximized direct exposure of the food, during cooking, to the heat enhancement means, and to further preclude against the inadvertent migration of the food into portions of the interior region which may be separated or insulated from the heat enhancement means by the presence of the inwardly extending gussets.

In a preferred embodiment of the invention, the bag panel attachment means comprises two regions of adhesive, each operably positioned between the back panel means and the second flaps of the first and second gusseted side panel means, respectively, for operable restrained attachment therebetween. Such adhesive may be positioned on the interior, or exterior portion of the bag means. In addition, it is also contemplated that instead of adhesive, other types of attachment means, such as non-metallized staples, tacks or clips, may also be utilized.

Each of the top ends of the front and back panel means and the first and second gusseted side panel means are operably sealable to one another after filling and prior to cooking, and then releasable from each other after cooking, by bag closure means. Accordingly, the bag closure means form a substantially sealed top region after the food is operably positioned within the interior region, which may be re-opened for exposure to the food after cooking.

In the preferred embodiment of the invention, the bag closure means comprises adhesive means which are operably positioned adjacent to the top end of the interior surfaces of the front and back panel means and the corresponding adjacent portions of the first and second flaps of the first and second gusseted side panel means. The bag closure means are releasable after the food has been fully cooked within the interior region of the bag means. Furthermore, it also intended that the adhesive used at least partially fatigues upon exposure of a predetermined amount of cooking of the food. The adhesive used to seal the bag is commercially available and known to those skilled in the relevant art. Typically, a thin layer of thermosetting adhesive may be used which only activates by heat sealing after the bag is filled. The bag panel attachment means in contrast, may be formed by a different non-thermosetting adhesive that bonds without heat, or may comprise the same thermosetting adhesive as the bag closure means in much greater amounts so as to create adhesion without the need for heat sealing.

In one embodiment of the invention, the heat enhancement means comprises a heat absorbing susceptor member which is operably attached to at least a portion of the front panel means adjacent the food in the interior region of the bag means. However, it is also contemplated that the heat absorbing susceptor member be operably positioned within an oven proximate to at least a portion of the front panel means of the bag means, adjacent to the food in the interior region. Such an oven susceptor may comprise a conventional microwave browning tray.

In another embodiment of the invention, the heat enhancement means comprises a heat maintaining insulator member operably attached to at least a portion of the front panel means adjacent to the food in the interior region of the bag means. However, it is also contemplated that the insulator member be operably positioned within the oven proximate to at least a portion of the front panel means of the bag means, adjacent the food in the interior region of the bag means. Such an insulator may comprise insulating paper or paperboard or other paper insulating means—as described in Borek, U.S. Pat. No. 4,219,573.

In the preferred embodiment of the invention, each of the front and back panel means and the first and second gusseted side panel means of the bag means comprises an inner ply of substantially grease proof paper material and an outer ply of paper material. In that embodiment, the heat enhancement means is operably positioned between the inner and outer plies of paper material.

In another embodiment of the invention, at least a portion of the front panel means of the bag means positioned adjacent the interior region, comprises an inner ply of substantially grease proof paper material and an outer ply of paper material. In addition, the heat enhancement means is operably positioned between the inner and outer plies of paper material. Particularly, the front panel means and at least a portion of the first and second gusseted side panel means, may comprise an inner ply of substantially grease proof paper material and an outer ply of paper material, without a double ply construction for the remainder of the bag means. Alternatively the susceptor or insulator may be directly exposed to the food without the intervening grease proof paper ply.

In the preferred embodiment of the invention, each of the bottom ends of the front and back panel means and the first and second gusseted side panel means are operably configured to form a substantially sealed bottom region through adhesive attachment. In one such embodiment, the adhesively attached bottom ends are then further crimped and attached by adhesive to a portion of the exterior surface of one of the front and back panel means to further secure the substantially sealed bottom region. The adhesive to be used for sealing the bottom ends, as well as for the crimped portion of the bag may be of the same thermosetting material. Such materials are commercially available and known to those of ordinary skill in the art.

DETAILED DESCRIPTION OF THE DRAWINGS

Figure 1:
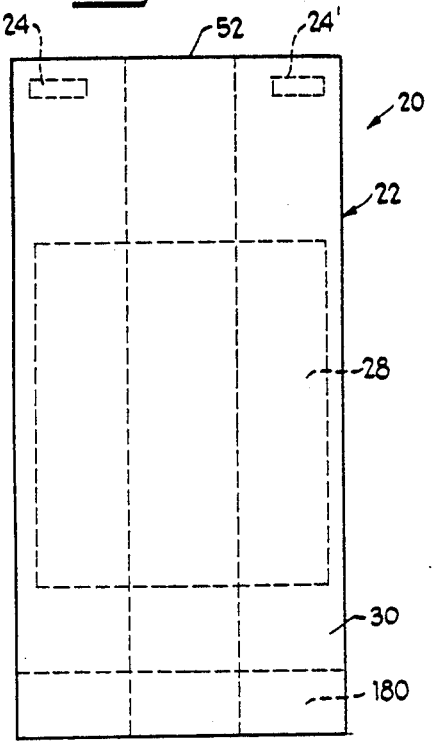
FIG. 1 of the drawings is a front elevational view of the present container apparatus showing, in particular and in dashed lines, the inwardly extending first and second gusseted side panel means, the bag panel attachment means, the positioning of the heat enhancement means in the front panel means and the substantially sealed, crimped bottom region of the bag means.

While this invention is susceptible of embodiment in many different forms, there is shown in the drawings and will herein be described in detail, several specific embodiments with the understanding that the present disclosure is to be considered as an exemplification of the principles of the invention and is not intended to limit the invention to the embodiments illustrated.

Figure 2:
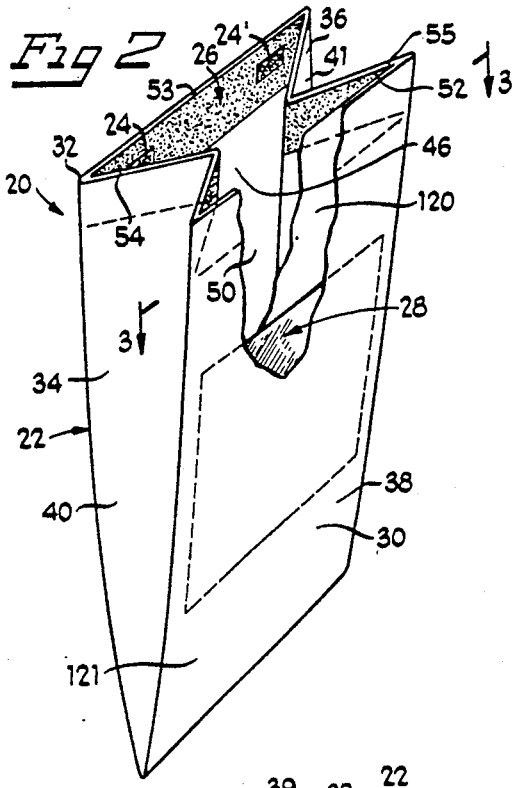
FIG. 2 of the drawings is a perspective view of the present container apparatus showing, in particular, the inwardly extending first and second gusseted side panel means, the positioning of the heat enhancement means between an inner ply and an outer ply of paper material, bag closure means positioned near the top edge of the front and back panel means and the first and second gusseted side panel means, as well as bag panel attachment means operably positioned on a portion of the bag closure means, on the back panel means.

Container apparatus 20 is shown in FIGS. 1 and 2 as comprising bag means 22, bag panel attachment means 24 and 24', bag closure means 26 (FIG. 2) and heat enhancement means 28. Bag means 22 includes front panel means 30, back panel means 32, first gusseted side panel means 34 and second gusseted side panel means 36. Each of the front and back panel means and the first and second gusseted side panel means have an exterior surface 38, 39 (FIG. 3), 40 and 41, respectively, an interior surface 45, 46, 47 and 48 (FIG. 3), respectively, which collectively defines interior region 50, top end 52, 53, 54 and 55, respectively, and a bottom end (not shown). As can be seen in FIGS. 6, 7, 11 and 12, the bottom ends are operably attached to each other so as to form a substantially sealed bottom region 75.

Figure 3:
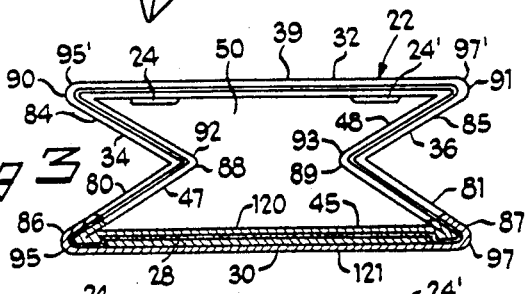
FIG. 3 of the drawings is a partial, cross-sectional top plan view of the container apparatus of FIG. 2 taken along lines 3—3 and looking in the direction of the arrows, showing, in particular, a double ply construction of the bag means, heat enhancement means operably positioned between the inner and outer plies of the front panel means, bag panel attachment means applied to the back panel means, as well as showing the first and second flaps of both of the first and second gusseted side panel means.

Front panel means 30 and back panel means 32 each include first sides 95 and 95' (FIG. 3) and second sides 97 and 97' (FIG. 3), respectively. First and second gusseted side panel means 34 and 36, respectively, as shown in FIG. 3 each include first flaps 80 and 81, respectively, and second flaps 84 and 85, respectively. First flaps 80 and 81 include first side edges 86 and 87 and second side edges 88 and 89, respectively. Second flaps 84 and 85 have first side edges 90 and 91 and second side edges 92 and 93, respectively. As shown in detail in FIG. 3, first side edge 86 and 87 of first flaps 80 and 81 are operably attached to first and second sides 95 and 97 of front panel means 30, respectively, while first side edges 90 and 91 of second flaps 84 and 85 are operably attached to first and second sides 95' and 97' of back panel means 32, respectively. Second side edges 88 and 92 of first and second flaps 80 and 84 each extend inwardly toward interior region 50 and are operably attached to each other so as to form inwardly extending first gusseted side panel means 34. Likewise, second side edges 89 and 93 of first and second flaps 81 and 85 respectively, are also attached to each other so as to form inwardly extending second gusseted side panel means 36.

Figure 14:
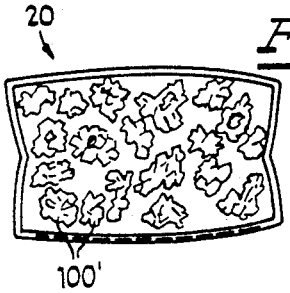
FIG. 14 of the drawings is a top plan view of the container apparatus after the sealed top region of the bag means has been opened, to, in turn, provide access to the completely cooked food within the interior region.

Inner ply of paper material 120 and outer ply of paper material 121 are shown in FIGS. 2 and 3. Although any type of commercially available material suitable for use in an oven, and more particularly a microwave oven, is contemplated for the construction of bag means 22, it is preferred that inner ply 120 be constructed from a substantially grease-proof paper material, while outer ply 121 be constructed from a substantially non-grease-proof material such as kraft paper. Furthermore, although bag means 22 is shown as comprising a "double ply" construction wherein inner ply 120 is coextensive with the entirety of outer ply 121, it is also contemplated that only a partial double ply construction (as shown in FIG. 14), or a completely single ply construction be utilized. Also shown in FIG. 5 is adhesive 59 which secures the inner ply and heat enhancement means 20 to outer ply 121.

Heat enhancement means 28 is shown in FIG. 2 and 3 as being operably disposed between inner ply 120 and outer ply 121 of front panel means 30. Although the heat enhancement means may be constructed from a metalized film coated on a polyester, or other type of suitable plastic substrate which is then operably positioned between inner ply 120 and outer ply 121 of front panel means 30, other types of available heat enhancers, such as those that are printed or sprayed directly on a portion of the front panel means, without the need for a substrate, is also contemplated. Furthermore, it is also contemplated that the heat enhancer could comprise an insulating material such as paper or paperboard, which serves to retain the heat produced within the interior region of the bag. In addition, although heat enhancement means 28 is shown attached to front panel means 30 of apparatus 20, it is also contemplated that the heat enhancer comprise a separate, unattached element, such as a microwave browning dish, or heat enhancer 103 integrated with oven surface 102 (FIG. 10) which will facilitate co-operation with adjacent front panel means 30 while cooking apparatus 20 is positioned within the oven.

Figure 4:
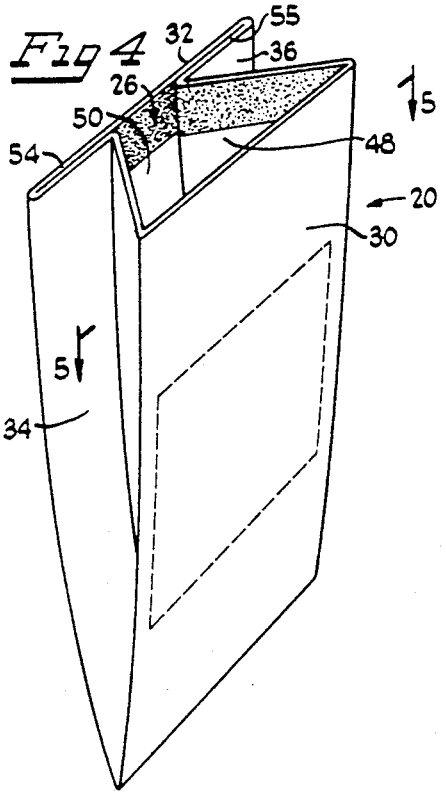
FIG. 4 of the drawings is a perspective view of the container apparatus after the bag panel attachment means on the back panel have been pressed and adhered against corresponding portions of the interior surfaces of the second flaps of the first and second gusseted side panel means, showing the substantially juxtaposed alignment of the second flaps against the back panel means.
Figure 5:
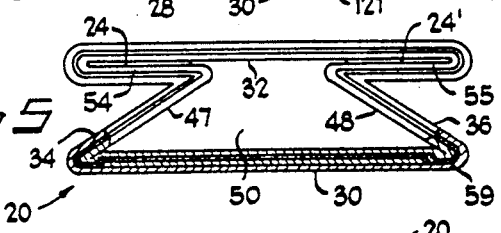
FIG. 5 of the drawings is a partial cross-sectional top plan view of the container apparatus of FIG. 4, taken along lines 5—5 and looking in the direction of the arrows, showing the juxtaposed alignment of the second flaps of the first and second gusseted side panel means, against the back panel means, the unfilled interior region after such alignment, the double ply construction of the bag means, and the positioning of the heat enhancement means between the inner and outer plies of the front panel means.
Figure 8:
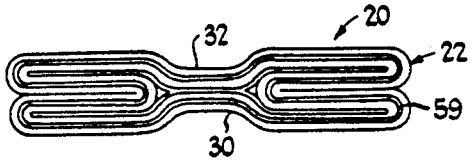
FIG. 8 of the drawings is a top plan view of the container apparatus of FIG. 7 taken along lines 8—8 and looking in the direction of the arrows, showing in particular, the releasably sealed top region of the bag means, the first and second gusseted side panel means and the pressure relief means.
Figure 9:
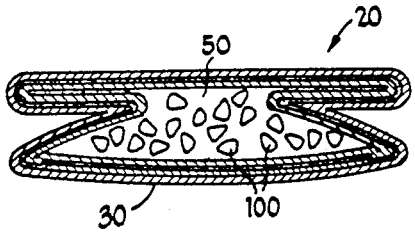
FIG. 9 of the drawings is a cross-sectional view of the container apparatus of FIG. 11 taken along lines 9—9 and looking in the direction of the arrows, showing, in particular, the operable positioning of the food after heating has begun and the maintained positioning of the food for direct exposure to the heat enhancer.

Container apparatus 20 is shown in FIGS. 4 and 5 after bag panel attachment means 24 and 24' on back panel means 32 have been operably attached to and adjacent top ends 54 and 55 of interior surface 47 and 48 of second flaps 84 and 85 (FIG. 3) of first and second gusseted side panel means 34 and 36, respectively. Accordingly, when such attachment has occurred, second flaps 84 and 85 will be maintained substantially juxtaposed against back panel means 32. Inasmuch as such attachment is completed prior to filling interior region 50 with food, and prior to sealing the top ends of the bag with closure means 26, the substantially juxtaposed alignment will serve to maintain substantially all of the food 100 to be filled therein substantially adjacent front panel means 30 of interior region 50 (FIGS. 5, 6 and 9), to maximize exposure of the food to the heat enhancer which, in turn, results in more uniform and complete cooking of the food—food which could otherwise be undercooked due to inadvertent migration between a portion of one or both of second flaps 84 and 85 and back panel means 32. Such juxtaposed positioning between the flaps and the back panel means upon attachment therebetween, helps maintain the positioning of the food 100 adjacent front panel means 30 during filling, shipping, storing and at least partial cooking of same. Although reference has been made to the attachment means being applied to the back panel means so as to maintain the second flaps of the first and second gusseted side panel means adjacent thereto, it is also contemplated that such attachment be between the front panel means and the first flaps of the gusseted side panels, where the heat enhancer is adjacent back panel means 32. Accordingly the terms front and back panel and the associated flaps should be deemed interchangeable with the panel not maintained adjacent the respective flaps of the gusseted sides being the actual panel adjacent the heat enhancement means during cooking of the food. Furthermore, although panel attachment means 24 and 24' are shown as a commercially available adhesive, other types of attachment means, such as nonmetallic clips or staples, positioned externally as well as internally, are also contemplated.

Bag closure means 26 is also shown in FIG. 4 as comprising a band of commercially available adhesive having characteristics which will partially fatigue after a predetermined period of cooking. Although such partial fatiguing will maintain closure of the top end of the bag means during and after cooking, it will additionally facilitate release of the top ends after the food has been properly cooked. Furthermore, attachment of closure means 26 is achieved by pressing the adjacently positioned portions of the front, back and first and second gusseted side panel means together (after attachment of bag panel attachment means 24 and 24' and after filling of the bag) and then applying heat thereto so as to melt the adhesive together.

Figure 6:
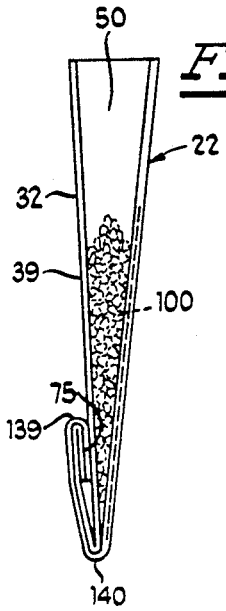
FIG. 6 of the drawings is an elevated side view of the present container apparatus after initial filling of the interior region of the bag means with food, showing in particular, the substantially sealed bottom region of the bag means, the lower fold which provides a bottom boundary, the adjacent positioning of the folded over portion with the back panel means, as well as the unoccupied area of the interior region after the food has been properly filled within same.
Figure 7:
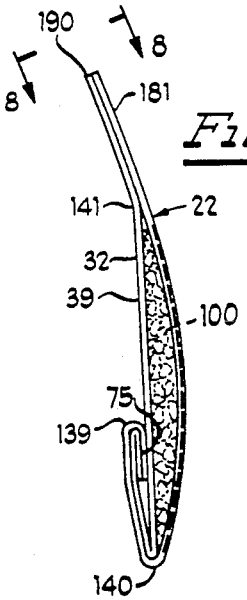
FIG. 7 of the drawings is an elevated side view of the present container apparatus showing in particular, the operable positioning of the food in the interior region after it has been completely filled, the adjacent positioning of the food relative to the heat enhancement means in the front panel means, as well as the initiation of the upper fold which serves as an upper boundary for precluding inadvertent migration of uncooked food.
Figure 12:
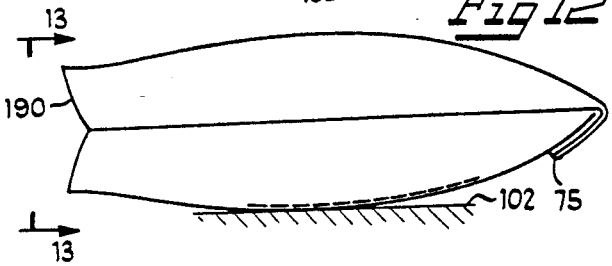
FIG. 12 of the drawings is an elevated side view of the container apparatus, after cooking of the food has been completed, showing in particular, the expanded gusseted side walls, as well as the substantially sealed bottom region.

Operable positioning of the food to be cooked within interior region 50 of bag means 22, after the initial filling of same, is shown in FIG. 6 prior to sealing top ends 52, 53, 54 and 55 (FIG. 2) of the respective front, back, first gusseted side and second gusseted side panel means, and then shown after sealing the top ends in FIG. 7. Prior to filling the food within interior region 50, the bottom ends of bag means 22 are operably attached to adjacent portions of each other by adhesive. After the bottom ends are properly adhered, bottom fold 139 is formed adjacent the bottom of bag means 22 so as to form sealing flap 180 (as shown in FIG. 1). Sealing flap 180 is then folded along lower fold 139 until it is positioned adjacent exterior surface 39 of a portion of back panel means 32 located above fold 140. Sealing flap 180, and in turn the attached bottom ends of the bag means are thus crimped and attached to the adjacent portion of back panel means 32 so as to form a substantially sealed bottom region 75. While the invention may be utilized with such a crimped, or pinched, bottom, as shown in FIGS. 1, 6, 7, 10 and 11, it is also contemplated that the invention alternatively utilize a square-bottomed bag. The adhesive used to attach sealing flap 180 to back panel means 32 may be of the same material used to seal the bottom ends of the bag means. Such adhesive is commercially available and readily known to those with ordinary skill in the relevant art. Also shown in FIGS. 6 and 7 is lower fold 140 which is positioned above bottom fold 139 and serves to form a lower boundary for the food being inserted within interior region 50.

After a predetermined amount of food has been inserted within interior region 50, upper fold 141 (FIG. 7) defining an upper bag portion 181 is formed. Upper fold 141 serves to define an upper boundary so as to help preclude migration of the food thereabove during shipping, storing and partial cooking of same. Furthermore, either after, or in conjunction with the initial formation of upper fold 141, top ends 52, 53, 54 and 55 (FIG. 2) of bag means 22 are releasably sealed together by the bag closure means 26 (FIG. 2) so as to form releasably sealed top region 190. After top region 190 is formed, the upper portion 181 of the bag is folded along upper fold 141 until the upper bag portion 181 is positioned adjacent a portion of back panel means 32 (as shown in FIG. 10).

Figure 10:
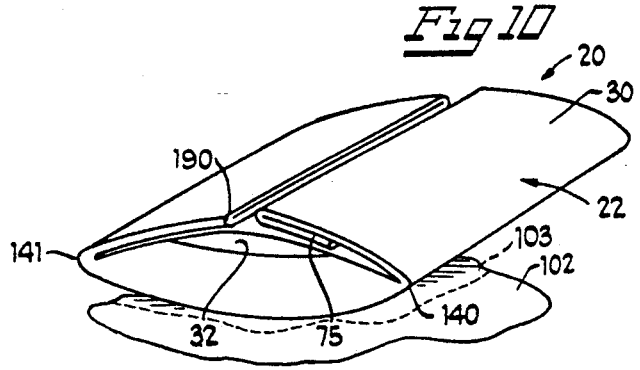
FIG. 10 of the drawings is a perspective view of the present container apparatus after the food has been filled in the interior region, the top end has been releasably sealed and the bag means has been folded along the upper and lower folds, showing, in particular, the lower portion of the bag means and the top portion of the bag means folded along the lower and upper folds respectively, so that such portions are adjacently positioned with corresponding portions of the back panel means, as well as showing optional heat enhancement means in the oven support.

Container apparatus 20 is shown in FIG. 10 after food 100 has been inserted within interior region 50 (FIG. 6 and FIG. 9) and after the top and bottom ends of bag means 22 have been operably sealed. As can be seen, substantially sealed bottom region 75 and releasable top region 190 have been folded toward back panel means 32. Such sealed and folded positioning of apparatus 20 comprises the positioning of the apparatus for shipping, storing and initiation of the cooking of the food therewithin upon insertion within an oven.

Cooking food within container apparatus 20 is accomplished by a user inserting apparatus 20 within an oven so that a portion of front panel means 30 is positioned adjacent supporting surface 102 within the oven. Inasmuch as heat enhancement means 28 (FIG. 11) may be operably attached to front panel means 30, the heat enhancement means will likewise be positioned adjacent supporting surface 102. If, on the other hand, the heat enhancement means comprises an element separate from container means 20, such as element 103 (FIG. 10), then front panel means 30 should be positioned adjacent to the separate heat enhancement means.

After container apparatus 20 is properly inserted within the oven, the oven door is shut and initiation of the heating of the food is commenced. As the heat process continues, heat enhancement means 28 will either absorb and intensify the heat, or concentrate the heat to the food if an insulator. Accordingly, any food positioned adjacent the heat enhancement means will be exposed to greater and/or more concentrated levels of heat. Conversely, any food which is not adjacent heat enhancement means 28 will receive less heat and, in turn, cook at a different rate than the adjacently positioned food. Inasmuch as food 100 positioned within interior region 50 (FIG. 9) of bag means 22 is maintained more effectively adjacent heat enhancement means 28 as the result of bag panel attachment means 24 and 24' (as shown in FIGS. 2 and 5 and as previously explained), and not permitted to migrate behind gusset sides 92 and 93, where such paper gussets serve to insulate against heat transmission, the food will be cooked uniformly and complete.

Figure 11:
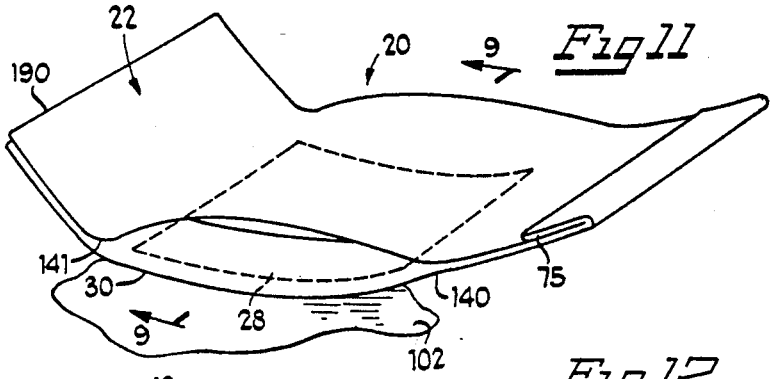
FIG. 11 of the drawings is a perspective view of the present container apparatus after cooking has initiated, showing in particular, the initial unfolding of the upper and lower folds as well as the alternative positioning of the heat enhancement means in the bag.

As the food continues to cook, pressure within interior region 50 of bag means 22 begins to develop. Such pressure causes upper and lower folds 140 and 141, respectively, to begin to unfold, as shown in FIG. 11. Further heating of the food results in additional pressure which in turn causes bag means 22, and more particularly interior region 50, to expand (as can be appreciated in FIG. 12) so as to enable the cooked portions of the food, such as fully popped popcorn kernels, to migrate away from heat enhancement means 28, while at the same time allowing the uncooked portions of the food, such as unpopped popcorn kernels, to cook—thereby enabling substantially complete and uniform cooking of all of the food.

Figure 13:
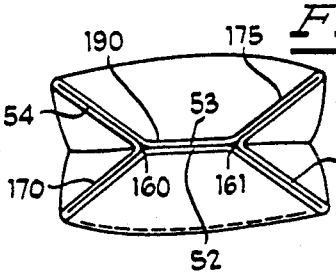
FIG. 13 of the drawings is a top plan view of the sealed container apparatus after the food within the interior region has been fully cooked, showing in particular, the releasably sealed, top region, as well as the two pressure relief vents which allow for the release of pressure, or steam, built up within the interior region of the bag means.

Although pressure builds within interior region 50 of bag means 22 during the cooking process, inadvertent rupturing of the bag, and more particularly inadvertent fatiguing of releaseably sealed top region 190, is precluded as a result of pressure relief vents 160 and 161, as shown in FIG. 13. These relief vents facilitate the continuous release of the pressure within interior region 50 during the cooking process.

After the food in container apparatus 20 is completely cooked 100' (FIG. 14) and removed from the oven, bag closure means 26 (FIG. 2) will have partially fatigued from steam and pressure generated during cooking. Accordingly, access to the food within interior region 50 is achieved by conventionally grasping the two opposed top portions, such as opposed top portions 170 and 175 (FIG. 13), and then manually pulling same in opposite directions. Such pulling will then cause total fatigue of bag closure means 26, and, in turn, the release of substantially all portions of top ends 52, 53, 54 and 55 from adjacently attached portions of same—thereby exposing, and enabling the release of the fully cooked food 100' from within container apparatus 20, as shown in FIG. 14.

Figure 15:
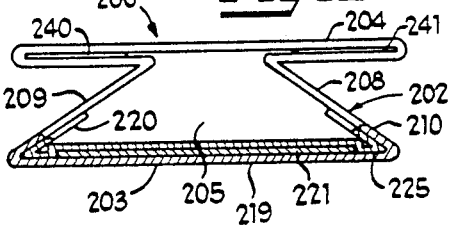
FIG. 15 of the drawings is a partial cross-sectional top plan view of the container apparatus, showing in particular, the double ply construction of only the front panel means and a portion of the gusseted side panel means, as well as the positioning of the heat enhancement means between the inner and outer plies of the front panel means.

An alternative embodiment of container apparatus 200 is shown in FIG. 15 as including bag means 202, heat enhancement means 221, interior region 205 and panel attachment means 240 and 241. Bag means 202 includes front panel means 203, back panel means 204, first gusseted side panel means 209 and second gusseted side panel means 210. Bag means 202 further includes first ply of paper material 219 which completely surrounds interior region 205, and second ply of paper material 220 which is coextensive with front panel means 203 and a small portion of first and second gusseted side panel means 209 and 210. Heat enhancement means 221 is operably positioned between first and second plies 219 and 220, respectively, and positioned juxtaposed front panel means 203. When such a partial two ply construction is utilized, it is preferred that both plies comprise grease proof material. Also shown in FIG. 15 is adhesive 225 which secures second ply 220 to heat enhancement means 221, and in turn both of these to to the first ply of material 221.

The foregoing description and drawings merely explain and illustrate the invention and the invention is not limited thereto except insofar as the appended claims are so limited as those skilled in the art who have the disclosure before them will be able to make modifications and variations therein without departing from the scope of the invention.

What is claimed is:

1. A container apparatus for use in filling, storing, shipping and cooking various types of food, in which the container apparatus facilitates and maintains the positioning and cooking of the food in a substantially restricted predetermined location within the cooking apparatus to, in turn, maximize exposure of said food, during cooking, to a heat enhancer positioned within an oven, or positioned within the container apparatus itself, towards improving and enhancing the cooking of the food therewithin, said container apparatus comprising:

bag means having front panel means and back panel means each of said front and back panel means having first and second sides respectively and converging at first and second opposite sides of said bag means;

first gusseted side panel means at said first side of said bag means for operably connecting said first side of each of said front and back panel means, and second gusseted side panel means at said second side of said bag means for operably connecting said second side of each of said front and back panel means, each of said first and second gusseted side panel means being operably positioned adjacent each of said front and back panel means, respectively, and opposite in position to each other, said front and back panel means and said first and second gusseted side panel means each having an exterior surface, an interior surface collectively defining an interior region, a top end and a bottom end, wherein said bottom ends are operably configured to form a substantially sealed bottom region, said first and second gusseted side panel means each including a first flap having a first side edge operably attached to said first and second sides of said front panel means, respectively, and a second side edge operably positioned opposite to said first side edge of said first flap and extending inwardly toward said interior region of said bag means, said first and second gusseted side panel means each further including a second flap having a first side edge operably attached to said first and second side of said back panel means, respectfully, and a second side edge operably positioned opposite said first side edge of said second flap and extending inwardly toward said interior region of said bag means, each of said second side edges of said first and second flaps being attached to each other respectfully so as to form inwardly extending gussets;

heat enhancement means operably positioned proximate to said front panel means for intensifying and concentrating heat to enhance the cooking of said food;

bag panel attachment means operably located proximate said top end of both said front and back panel means at a position substantially above said predetermined location of said food within said cooking apparatus, said bag panel attachment means being operably sealed to maintain said second flaps of said first and second gusseted side panel means and said back panel means adjacent each other prior to filling said cooking apparatus with said food, to further maintain said respective second flaps substantially juxtaposed against said back panel means during the filling, storing and shipping of said bag means and during at least a portion of said cooking of said food within said bag means;

said bag panel attachment means operably segregating and maintaining said food in said interior region during filling, storing and shipping of said apparatus for maximized direct exposure of said food, during cooking, to said heat enhancement means, and to further preclude against the inadvertent migration of said food into portion of said interior region separated from said heat enhancement means by said inwardly extending gussets, each of said top ends of said front and back panel means and said first and second gusseted side panel means being operably sealable to one another prior to cooking and releasable from each other after cooking, by bag closure means, so as to form a substantially sealed top region after said food is operably positioned within said interior region, which may be re-opened for exposure to said food after cooking.

2. The invention according to claim 1 in which said bag panel attachment means comprises two regions of adhesive, each operably positioned between said back panel means and said second flaps of said first and second gusseted side panel means respectively, for operable restrained attachment therebetween.

3. The invention according to claim 1 in which said bag closure means comprises adhesive means operably applied adjacent said top end of said interior surfaces of said front and back panel means and said corresponding adjacent portions of said first and second flaps of said first and second gusseted side panel means;

said bag closure means being releasable after said food within said interior region of said bag means has been fully cooked.

4. The invention according to claim 1 in which said bag closure means comprises adhesive which at least partially fatigues upon exposure of a predetermined amount of cooking of said food.

5. The invention according to claim 1 in which said heat enhancement means comprises a heat absorbing susceptor member operably attached to at least a portion of said front panel means adjacent said food in said interior region of said bag means.

6. The invention according to claim 1 in which said heat enhancement means comprises a heat maintaining insulator member operably attached to at least a portion of said front panel means adjacent said food in said interior region of said bag means.

7. The invention according to claim 1 in which said heat enhancement means comprises a heat maintaining insulator member operably positioned within said oven proximate to at least a portion of said front panel means of said bag means, adjacent said food in said interior region of said bag means.

8. The invention according to claim 1 in which said heat enhancement means comprises a heat maintaining insulator member operably positioned within said oven proximate to at least a portion of said front panel means of said bag means, adjacent said foot in said interior region of said bag means.

9. The invention according to claim 1 in which each of said front and back panel means and said first and second gusseted side panel means of said bag means comprise an inner ply of substantially grease proof paper material and an outer ply of paper material, said heat enhancement means being operably positioned between said inner and outer plies of paper material.

10. The invention according to claim 1 in which at least a portion of said front panel means of said bag means positioned adjacent said interior region, comprises an inner ply of substantially grease proof paper material and an outer ply of paper material, said heat enhancement means being operably positioned between said inner and outer plies of paper material.

11. The invention according to claim 10 in which said front panel means and at least a portion of said first and second gusseted side panel means comprise an inner ply of substantially grease proof paper material and an outer ply of paper material, said heat enhancement means being operably positioned in said front panel between said inner and outer plies of paper material.

12. The invention according to claim 1 in which each of said bottom ends of said front and back panel means and said first and second gusseted side panel means are operably configured to form a substantially sealed bottom region through adhesive attachment, said adhesively attached bottom ends of said front and back panel means and said first and second gusseted side panel means being further crimped and attached by adhesive to a portion of said exterior surface of one of said front and back panel means to further secure said substantially sealed bottom region.

* * * * *